US008365431B1

(12) United States Patent
Parish

(10) Patent No.: US 8,365,431 B1
(45) **Date of Patent: *Feb. 5, 2013**

(54) GLOVE DRYING APPARATUS

(76) Inventor: Jarrett P. Parish, Bushnell, FL (US)

( * ) Notice: Subject to any disclaimer, the term of this patent is extended or adjusted under 35 U.S.C. 154(b) by 445 days.

This patent is subject to a terminal disclaimer.

(21) Appl. No.: 12/657,873

(22) Filed: Jan. 28, 2010

Related U.S. Application Data

(63) Continuation-in-part of application No. 11/999,801, filed on Dec. 7, 2007, now Pat. No. 8,079,156.

(51) Int. Cl.
*F26B 25/00* (2006.01)

(52) U.S. Cl. ..... 34/103; 34/105; 34/106; 34/239

(58) Field of Classification Search ..... 34/103, 34/104, 106, 239, 437, 105; 40/662–669
See application file for complete search history.

(56) References Cited

U.S. PATENT DOCUMENTS

| | | | | |
|---|---|---|---|---|
| 1,969,953 | A * | 8/1934 | Swartz | 34/79 |
| 4,209,913 | A | 7/1980 | Wallin et al. | |
| 4,991,756 | A | 2/1991 | Benjamin | |
| 5,117,565 | A | 6/1992 | Willenbacher, Jr. | |
| 5,406,717 | A | 4/1995 | Dofka | |
| 5,570,515 | A | 11/1996 | Schulte | |
| 5,604,993 | A | 2/1997 | Auckerman | |
| 5,983,518 | A | 11/1999 | Ellenburg | |
| 6,499,227 | B1 | 12/2002 | Jacobson | |
| 8,079,156 | B1 * | 12/2011 | Parish | 34/103 |
| 2002/0138953 | A1 | 10/2002 | Passafiume | |
| 2003/0213144 | A1 | 11/2003 | Jacobson | |

* cited by examiner

*Primary Examiner* — Jiping Lu
(74) *Attorney, Agent, or Firm* — Frijouf, Rust & Pyle, P.A.

(57) ABSTRACT

A glove holder is disclosed for coupling a glove to an air vent. The air vent discharges an air flow over a fan shroud. The glove holder comprises a cylinder having an interior surface. The interior surface defines an interior bore. The cylinder is inserted into the glove. A support arm extends from a first end to a second end. The first end of the support arm is secured to the interior surface of the cylinder. The second end of the support arm is positioned within the interior bore. A key receiver is secured to the second end of the support arm. A clamp extends between a key and a conical backing. The key slidably engages the key receiver and the conical backing frictionally engages the air vent. The air flow is displaced from the air vent, through the interior bore of the cylinder and through the body of the glove for drying the glove.

4 Claims, 10 Drawing Sheets

GLOVE DRYING APPARATUS

CROSS-REFERENCE TO RELATED APPLICATIONS

This is a continuation-in-part of U.S. patent application Ser. No. 11/999,801 filed Dec. 7, 2007 now U.S. Pat. No. 8,079,156. All subject matter set forth in application Ser. No. 11/999,801 is hereby incorporated by reference into the present application as if fully set forth herein.

This application claims benefit of U.S. Patent Provisional application Ser. No. 60/873,487 filed Dec. 7, 2006. All subject matter set forth in provisional application Ser. No. 60/873,487 is hereby incorporated by reference into the present application as if fully set forth herein.

BACKGROUND OF THE INVENTION

1. Field of the Invention

This invention relates to a drying and more particularly to the improved holder for coupling a glove to an air vent that discharges airflow for drying the glove.

2. Background of the Invention

Various types of drying devices have been proposed by the prior art for removing moisture from a glove. Moisture may accumulate within a glove from perspiration of the wearer or from the surrounding environment such as precipitation. If a high moisture contents is allowed to remain for prolonged periods, the glove may sustain permanent damage. In addition, a glove with high moisture content may not function properly. Furthermore, the wearer may incur an injury from utilizing a glove with high moisture content.

One method of removing the moisture from a glove includes placing the glove in an environment wherein in the surrounding atmosphere contains less moisture than the glove. The surrounding atmosphere absorbs the moisture within the glove and displacing the moisture from the glove to the surrounding atmosphere. However, this method requires prolonged time periods. The following U.S. Patents are examples of attempt of the prior art to solve these problems.

U.S. Pat. No. 4,209,913 to Wallin, et al. discloses a method and device for drying gloves, particularly golf gloves, comprises a drying member shaped to resemble a human hand. The drying member is sufficiently rigid such that the golf glove is inserted thereon and retained in an open orientation substantially conforming to the orientation in which the glove is normally worn on a human hand. However, the drying member is also semi-resilient such that the drying member may be temporarily deformed inwardly to allow the glove to be removed therefrom. In one embodiment, the drying member is hollow having a plurality of perforations therein. This allows ambient air or a drying medium, such as heated air, to be circulated from the interior of the drying member into contact with the glove for the purpose of drying the glove.

U.S. Pat. No. 4,991,756 to Benjamin discloses a device for drying wet gloves or mittens or for drying portions of other wet clothing having inside openings therein which are substantially circular in cross-section and which are of a depth of at least about three inches. The device is a hollow cylindrical dryer or is slightly tapered from cylindrical to slightly conically shaped. The main portion of the dryer between its ends preferably consists of a grid of many square or diamond shaped ventilation holes to facilitate evaporation of moisture. The dryer can be made of flexible plastic material and molded into its final shape (and also into such a shape that a number of said dryers can be "nested" inside each other); or the dryer can be molded in an essentially planar condition and then forced by the user into its shape described above, by slight exertion of hand pressure.

U.S. Pat. No. 5,117,565 to Willenbacher, Jr. discloses a glove drying frame configured as a human hand is formed of a wire mesh hollow body to accommodate a glove thereon, with the hollow body mounting a support clip to a wrist portion of the hollow body to permit suspension of the hollow body permitting free-flow of drying air to be directed interiorly of the hollow body. The invention further includes a mounting framework for support of a plurality of hollow bodies permitting directing of a drying medium within the hollow bodies.

U.S. Pat. No. 5,406,717 to Dofka discloses a compact, break apart drying rack for utility gloves includes a drain basin for collection of fluid and moisture drips, said drain basin having a pour off flange for disposal of accumulated liquid. Situated on the floor of the drain basin are two pylons which serve as bases for vertical support rods comprised of two hollow, telescoping tubes with adjustment holes for aligning and clamping into expanding or reducing position, said clamping means completed with spread ring discs which serve two purposes: to connect with and maintain vertical rod position and to spread open utility glove surfaces for drying internally and externally. Positioning the utility gloves on the drying rack permits air drying of utility gloves thereby destroying pathogens present on wet gloves, preserves the quality of the glove material, avoids contamination to the work site by eliminating pooling of fluids on wet gloves deposited on counter tops. The break apart feature permits each member of the drying rack to be placed into the autoclave chamber for periodic total sterilization and protection against cross contamination for the operator, work site or patient.

U.S. Pat. No. 5,570,515 to Schulte discloses a light weight, portable, and totally self contained unit for drying footwear, gloves and the like. A motor driven fan is energized by a battery pack by way of a switch to draw in air and through ports in a housing and to direct the air into a Y-divider and through two discharge tubes and into the item requiring drying.

U.S. Pat. No. 5,604,993 to Auckerman discloses devices and methods for drying the inside surfaces of gloves. The glove drying devices include a perforated hollow drying form in the shape of a hand. A tube is mounted to the inside of the drying form in order to improve the air flow into the interior of the form. A heating means is provided for mounting inside the tube in order to heat the air which flows into the drying form and to enhance the air flow.

U.S. Pat. No. 5,983,518 to Ellenburg discloses a golf glove drying attachment for a golf cart or a golf bag, intended to improve air circulation through the glove while the user is on the golf course. The glove drying attachment includes a slightly tapered shell for holding the glove, and a clamp for attaching to a golf cart. As the golf cart is driven, wind from the golf cart dries the glove. Alternatively, the shell may include a battery powered fan, and attach to a golf bag.

U.S. Pat. No. 6,499,227 to Jacobson discloses a sports glove drying device. In one embodiment, an accessory allows attachment of gloves to a vehicle. The aerodynamic drag of the wind against the vehicle during the vehicle's movement speeds up the drying of the gloves. In a further embodiment, an accessory for adhering to a vehicle, existing tags or so forth, allowing any surface to be utilized for drying the gloves. In further embodiments, the accessory includes a receptacle for interchanging promotional material therein. In a preferred embodiment, the accessories are used with golf gloves and can be attached to a golf cart. In alternate embodiments, the accessories can be used with any other sporting activity using gloves, such as bicycling, baseball, or so forth.

U.S. Patent Application 20020138953 to Passafiume discloses a golf glove holder adapted to be mounted to a golf cart frame member. The golf glove holder includes a main body and an attachment member affixed to the main body for attachment of the golf glove holder to the golf cart body frame member. The main body of the golf glove holder is preferably cylindrical and includes a golf glove holder at one end of the main body. The golf glove holder is configured to releasably hold an interior wrist sweat band of a golf glove along at least a portion of an outer circumference of the main body such that air flowing through the main body is directed into the glove. Preferably, the golf glove holder comprises a strip of nylon hook material adhesively affixed to an outer circumference of one end of the main body. The nylon hook material strip is adapted to releasably hold the golf glove wrist sweat band. The main body is preferably a length of PVC plastic pipe having a outer diameter of 23/8 inches and a length of 21/2 inches. The attachment member is affixed to the main body and includes a clamp portion for attachment to a tubular frame portion of the golf car. Preferably the clamp portion is C-shaped in cross section with flexible extending arms adapted to wrap around a portion of the frame. An adjustable strap extends between the extending arms to force the arms against the frame thereby securing the golf glove holder to the golf cart frame.

U.S. Patent Application 20030213144 to Jacobson discloses a sports glove drying device. In one embodiment, an accessory allows attachment of gloves to a vehicle. The aerodynamic drag of the wind against the vehicle during the vehicle's movement speeds up the drying of the gloves. In a further embodiment, an accessory for adhering to a vehicle, existing tags or so forth, allowing any surface to be utilized for drying the gloves. In further embodiments, the accessory includes a receptacle for interchanging promotional material therein. In a preferred embodiment, the accessories are used with golf gloves and can be attached to a golf cart. In alternate embodiments, the accessories can be used with any other sporting activity using gloves, such as bicycling, baseball, or so forth.

Although the aforementioned prior art have contributed to the development of the art for drying a glove, none of these prior art patents have solved the needs of this art.

Therefore, it is an object of the present invention to provide an improved glove drying device for reducing the time needed to remove the moisture within the glove.

Another object of this invention is to provide an improved glove drying device that may secured to an airflow device.

Another object of this invention is to provide an improved glove drying device that may secured to more than one type of airflow device.

Another object of this invention is to provide an improved glove drying device is that easily operated.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention an relates to an improved glove holder for coupling a glove to an air vent. The glove has a body defining an interior cavity. The body has an aperture for accessing the interior cavity. The air vent discharges an air flow over a fan shroud. The air flow dries the glove. The glove holder comprises a cylinder having an intake end, an exhaust end, an interior surface, and an exterior surface. The interior surface defines an interior bore extending from the intake end to the exhaust end. The cylinder is inserted through the aperture and into the interior cavity of the body for positioning the exterior surface of the cylinder adjacent to the body of the glove. A support arm extends from a first end to a second end. The first end of the support arm is secured to the interior surface of the cylinder. The second end of the support arm is positioned within the interior bore. A key receiver is secured to the second end of the support arm. The key receiver includes a first receiver channel and a second receiver channel separating by a receiver plate. A clamp extends between a key and a conical backing. The key includes a first key flange and a second key flange separating by a key plate. The conical backing includes a tapering surface contracting to a point. The first key flange and the second key flange slidably engage the first receiver channel and the second receiver channel respectively for positioning the receiver plate adjacent to the key plate. The conical backing engages the fan shroud of the air vent for positioning the fan shroud between the key and the conical backing. The air flow is displaced from the air vent, through the interior bore of the cylinder and through the body of the glove.

In a more specific embodiment of the invention, a conical spacer couples the key and the conical backing for spacing the conical backing from the cylinder. A grasping groove is interposed between the conical spacer and the conical backing. The grasping groove defines a conical grasping surface on the conical backing and a spacer grasping surface on the conical spacer. The conical spacer includes a second tapering surface for preventing the shroud from contacting the cylinder. The grasping groove, the conical grasping surface and the spacer grasping surface engage the fan shroud of the air vent for securing the fan shroud to the cylinder.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
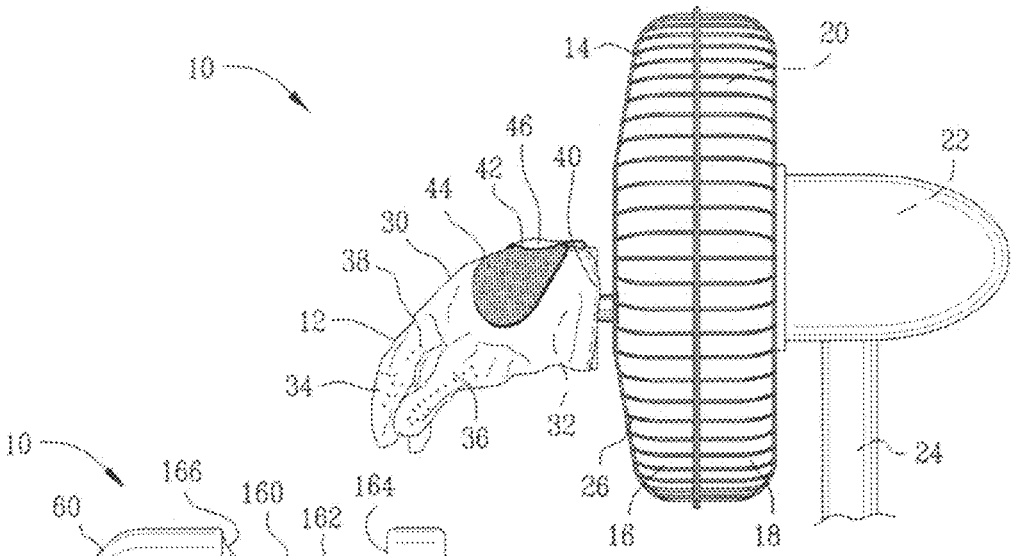
FIG. 1 is a side view of a first embodiment of a holder for coupling a glove to an air vent incorporating the present invention.
Figure 2:
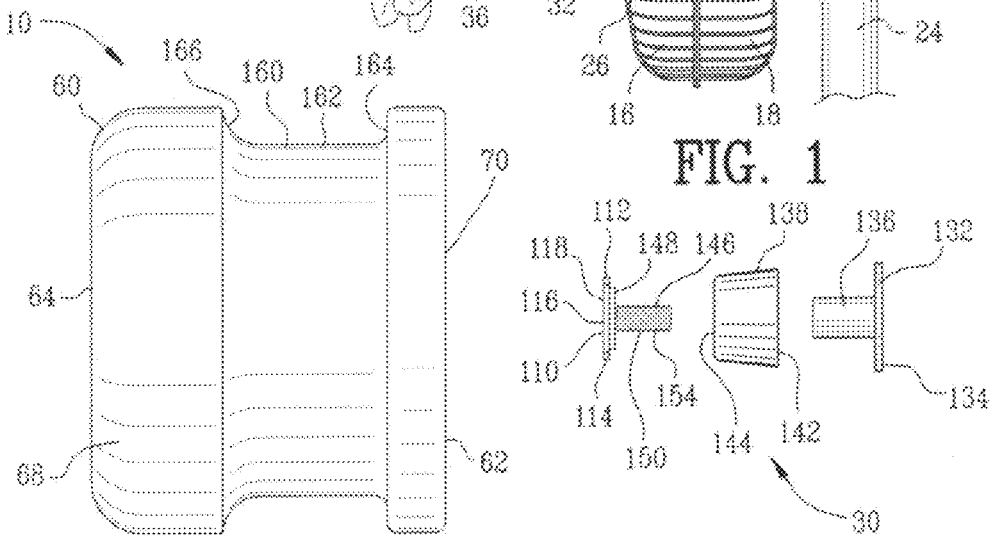
FIG. 2 is an exploded view of the first embodiment of the holder utilized in FIG. 1.
Figure 3:
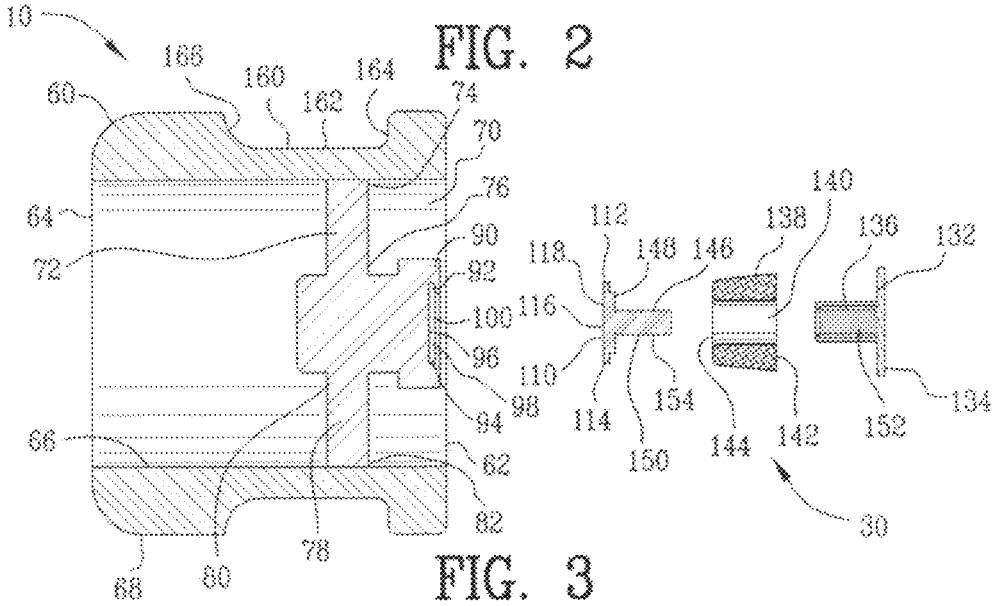
FIG. 3 is a centered sectional view of FIG. 2.
Figure 4:
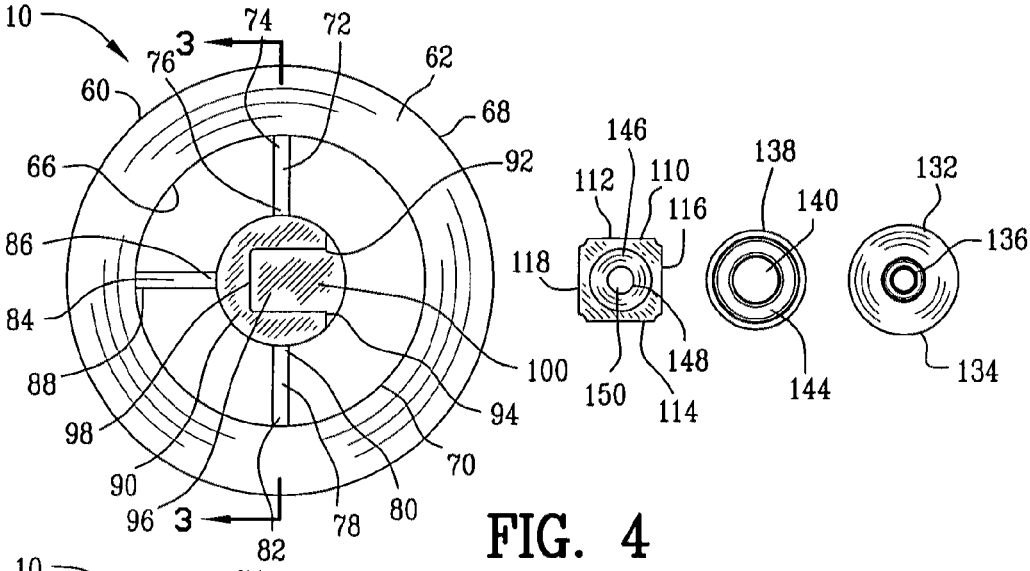
FIG. 4 is a front view of the holder of FIG. 2.
Figure 5:
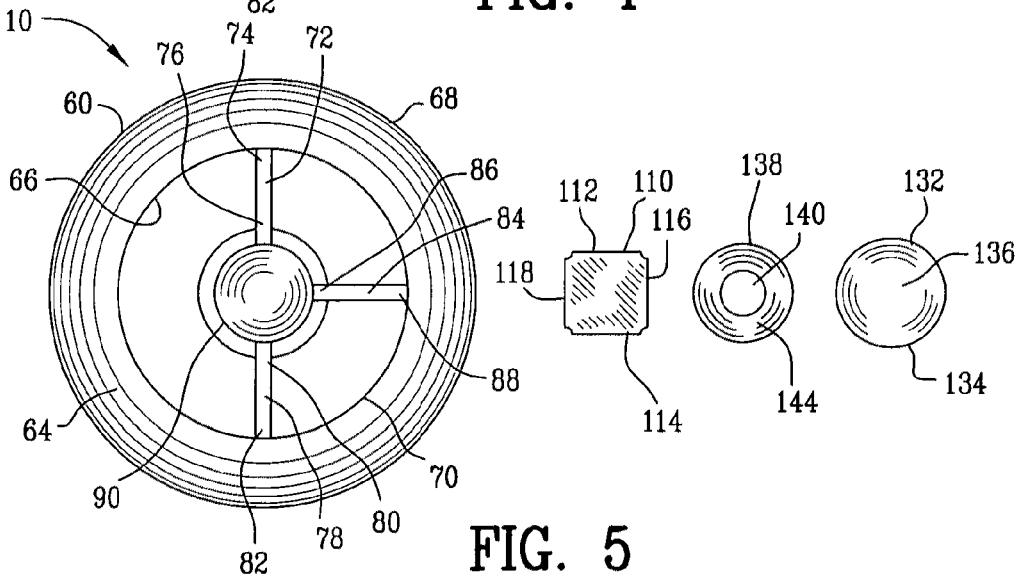
FIG. 5 is a rear view of the holder of FIG. 2.

FIGS. 1 thru 16 are various view of a first embodiment of a glove holder 10 for coupling a glove 12 to an air vent 14. The air vent 14 may include a front air vent 16 and a rear air vent 18 for housing a blade assembly 20. The blade assembly 20 is driven by a motor 22. The motor 22 may be supported by a stand 24. The front air vent 16 may include a plurality of rods 26 for preventing an object from contacting the blade assembly 20 during rotation. As the motor 22 rotates the blade assembly 20, an air flow 28 is displaced from the blade assembly 20 and through the air vent 16.

The glove 12 includes a body 30 for defining an interior cavity 32. The body 30 may incorporate a plurality of finger bodies 34 and a thumb body 36. The body 30 may further include a plurality of vent openings 38 for permitting ventilation between the interior cavity 32 and the exterior of the glove 12. The body 30 of the glove 12 has an aperture 40 for the wearer to insert his hand within the interior cavity 32. The glove 12 may include a keeper 42 for limiting the expansion of the interior cavity 32 of the glove 12. The keeper 42 may include a first and a second Velcro portion 44 and 46 or cord 48.

The glove holder 10 comprises a cylinder 60 having an intake end 62, an exhaust end 64, an interior surface 66, and an exterior surface 68. The interior surface 66 defines an interior bore 70 extending from the intake end 62 to the exhaust end 64. A support arm 72 extends from a first end 74 to a second end 76. The first end 74 of the support arm 72 is secured to the interior surface 66 of the cylinder 60. The second end 76 of the support arm 72 is positioned within the interior bore 70.

In FIGS. 3, 4, 10 and 11 a key receiver 90 is secured to the second end 76 of the support arm 72. The key receiver 90 includes a first receiver channel 92 and a second receiver channel 94 separated by a receiver plate 96. The key receiver 90 may further include a third receiver channel 98 interposed between the first receiver 90 and the second receiver channel 94. The first and second receivers 90 and 92 and the receiver plate 96 define a rectangular groove 100.

Preferably, the cylinder 60, the support arm 72, and the key receiver 90 are an integral one piece unit constructed from a metallic, polymeric or other rigid material. Alternatively, the cylinder 60, the support arm 72, and the key receiver 90 may include individual components constructed from metallic, polymeric or other rigid material and fastened by welding, gluing or other fastening techniques.

The cylinder 60 may also incorporate a second support arm 78 extending from a first end 80 to a second end 82. The first end 80 of the second support arm 78 is secured to the interior surface 66 of the cylinder 60. The second end 82 of the second support arm 78 is positioned within the interior bore 70. The key receiver 90 is secured to the second end 82 of the second support arm 78. Furthermore the cylinder 60 may include a third support arm 84 extending from a first end 86 to a second end 88. The first end 86 of the third support arm 84 is secured to the interior surface 66 of the cylinder 60. The second end 88 of the third support arm 84 is positioned within the interior bore 70. The key receiver 90 is secured to the second end 88 of the third support arm 84. The addition of the second and third support arms 78 and 84 provide addition support between the cylinder 60 and the key receiver 90. Preferably, the cylinder 60, the second and third support arms 78 and 84, and the key receiver 90 are an integral one piece unit constructed from a metallic, polymeric or other rigid material. Alternatively, the cylinder 60, the second and third support arms 78 and 84, and the key receiver 90 may include individual components constructed from metallic, polymeric or other rigid material and fastened by welding, gluing or other fastening techniques.

A key 110 has a first key flange 112 and a second key flange 114 separating by a key plate 116. The key 110 may further include a third key flange 118 interposed between the first key flange 112 and the second key flange 114. The key 110 is positioned within the rectangular groove 100 such that the first key flange 112, second key flange 114 and the third key flange 118 slidably engage the first receiver channel 92, second receiver channel 94 and the third receiver channel 98 respectively. With the first key flange 112, second key flange 114 and third key flange 118 engaged with the first receiver channel 92, second receiver channel 94 and the third receiver channel 98 respectively, the receiver plate 96 is positioned adjacent to the key plate 116. The key 110 may not be displaced relative to the key receiver 90 unless the key 110 is slidably displaced within the rectangular groove 100 in the opposite direction from which the key 110 was inserted.

In FIGS. 2 thru 5 a clamp 130 is illustrated for securing to the air vent 14. The clamp 130 includes a backing coupler 132 having a backing plate 134 for positioning to the interior of the air vent 14 and a compression socket 136 for extending from the backing plate 134 to the exterior of the air vent 14. The compression socket 136 may include a female threading 152 extending the length of the compression socket 136. Preferably, the backing plate 134 and the compression socket 136 are an integral one piece unit constructed from an elastic polymer or other non-rigid material that is molded about the female threading 152. The female threading 152 may be constructed from a metallic, polymeric or other rigid material.

The clamp 130 further includes an annular spacer 138 defining a hole 140 for slidably receiving the compression socket 136, a first spacer surface 142 for positioning adjacent to the exterior of the air vent 14 and a second spacer surface 144. The length of the annular spacer 138 is greater than the length of the compression socket 136 such that the annular spacer 138 may be compressed around the compression socket 136. Preferably, the annular spacer 138 is an integral one piece unit constructed from an elastic polymer or other non-rigid material.

A frontal coupler 146 has a frontal plate 148 for positioning adjacent to the second spacer surface 144 of the annular spacer 138. The frontal coupler 146 also incorporates a compression rod 150 for extending through the hole 140 and threadably engaging the compression socket 136 for applying a compressive force between the frontal plate 148 and the backing plate 134. The compression rod 150 may include a male threading 154 for threadably engaging the female threading 152 of the compression socket 136. The male threading 154 threadably engages the compression socket 136 to reduce the length between the backing plate 134 of the backing coupler 132 and the first spacer surface 142 of the annular spacer 138. The backing plate 134 of the backing coupler 132 and the first spacer surface 142 of the annular spacer 138 compresses the air vent 14 for securing the glove holder 10 to the air vent 14.

Preferably, frontal plate 148, compression rod 150 and male threading 154 are an integral one piece unit constructed from a metallic, polymeric or other rigid material. Alternatively, the frontal plate 148, compression rod 150 and male threading 154 may include individual components constructed from metallic, polymeric or other rigid material and fastened by welding, gluing or other fastening techniques.

The key plate 116 is attached to the frontal plate 148 for securing the frontal coupler 146 of the clamp 130 to the key receiver 90 of the cylinder 60 upon the key 110 slidably engaging the rectangular groove 100. Preferably, the frontal coupler 146, and the key 110 may include an integral one piece unit constructed from a metallic, polymeric or other rigid material. Alternatively, the frontal coupler 146 and the key 110 may include individual components constructed from metallic, polymeric or other rigid material and fastened by welding, gluing or other fastening techniques.

Figure 6:
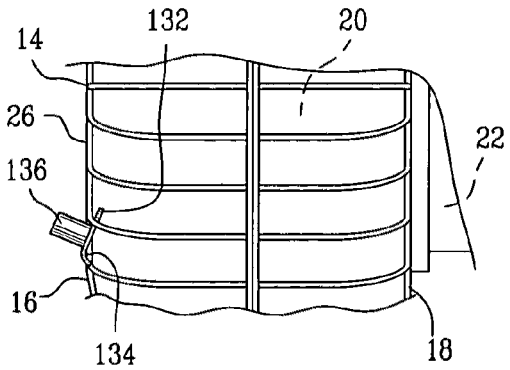
FIG. 6 is a magnified view of a lower portion of FIG. 1 illustrating a backing coupler engaging the air vent.
Figure 7:
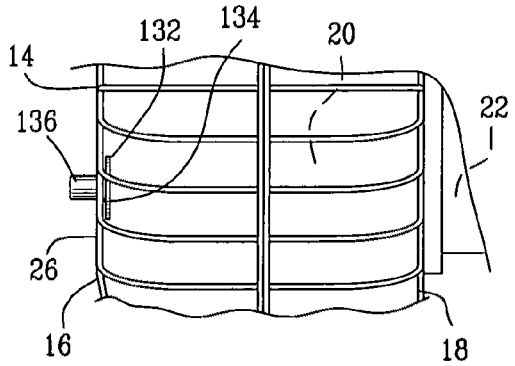
FIG. 7 is a view similar to FIG. 6 illustrating a backing plate positioned to the interior of the air vent.

FIGS. 6 thru 13 illustrate the steps utilized for securing the glove holder 10 to the air vent 14. In FIG. 6 the backing plate 134 is positioned between the plurality of rods 26 of the front air vent 16. Preferably, the backing plate 134 is positioned where the distance between two plurality of rods 26 is commensurate with the diameter of the compression socket 136. If the distance between the plurality of rods 26 is shorter than the diameter of the backing plate 134, the backing plate 134 may be distorted or bent such that the backing plate 134 may pass between the plurality of rods 26.

Figure 8:
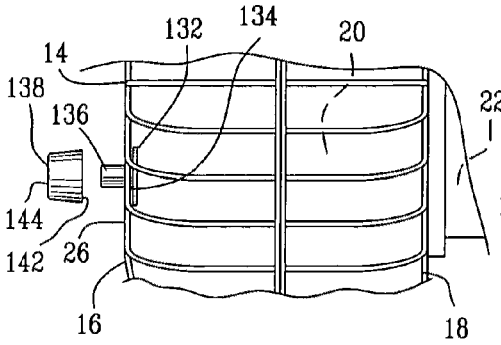
FIG. 8 is a view similar to FIG. 6 illustrating an annular spacer positioned for engaging the backing coupler.
Figure 9:
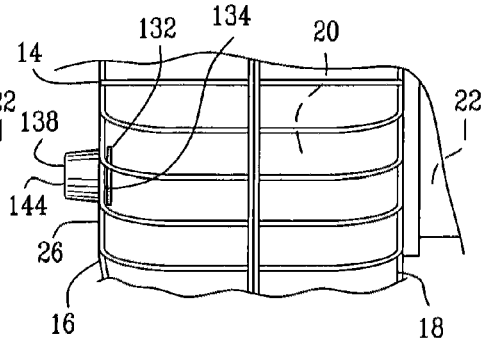
FIG. 9 is a view similar to FIG. 3 illustrating the annular spacer engaged with the backing coupler and a first spacer surface positioned to the exterior of the air vent.

FIGS. 8 and 9 illustrate the steps utilized for next positioning the annular spacer 138 around the compression socket 136. The length of the annular spacer 138 is greater than the length of the compression socket 136 such that the annular spacer 138 may be compressed between the backing plate 134 and the frontal plate 148.

Figure 10:
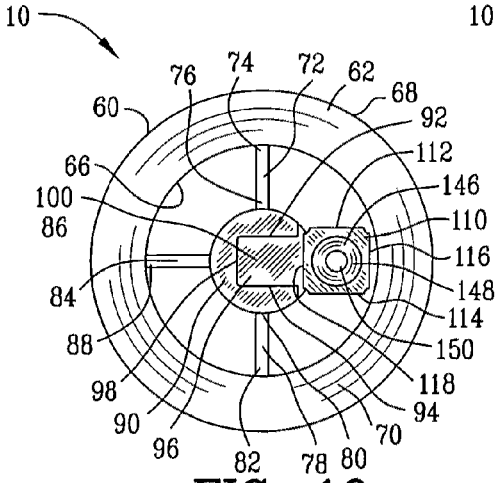
FIG. 10 is a view similar to FIG. 4 illustrating a key positioned for engaging a key receiver.
Figure 11:
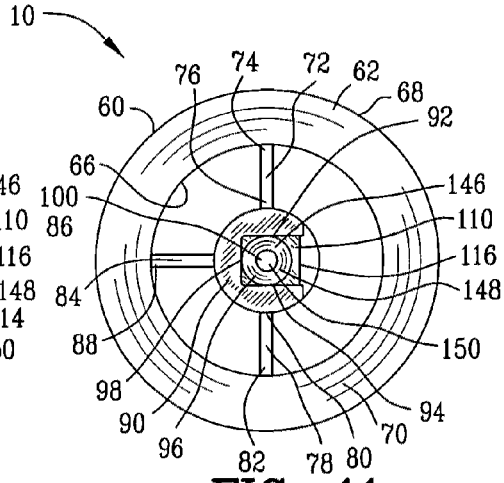
FIG. 11 is a view similar to FIG. 10 illustrating the key engaged with the key receiver.

FIGS. 10 and 11 illustrate the steps utilized for next coupling the backing coupler 132 of the clamp 130 to the cylinder 60. The key 110 is positioned within the rectangular groove 100 such that the first key flange 112 and second key flange 114 slidably engage the first receiver channel 92 and second receiver channel 94 respectively. The key 110 is slide within the rectangular groove 100 until the third key flange 118 slidably engages the third receiver channel 98.

With the first key flange 112, second key flange 114 and third key flange 118 engaged with the first receiver channel 92, second receiver channel 94 and the third receiver channel 98 respectively, the receiver plate 96 is positioned adjacent to the key plate 116. The key 110 may not be displaced relative to the key receiver 90 unless the key 110 is slidably displaced within the rectangular groove 100 in the opposite direction from which the key 110 was inserted.

Figure 12:
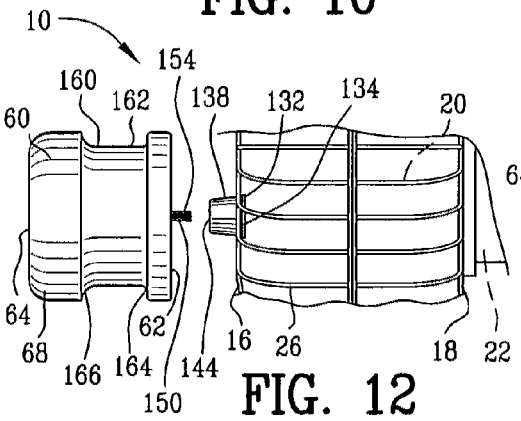
FIG. 12 is a view similar to FIG. 9 illustrating a compression rod positioned for engaging a compression socket.
Figure 13:
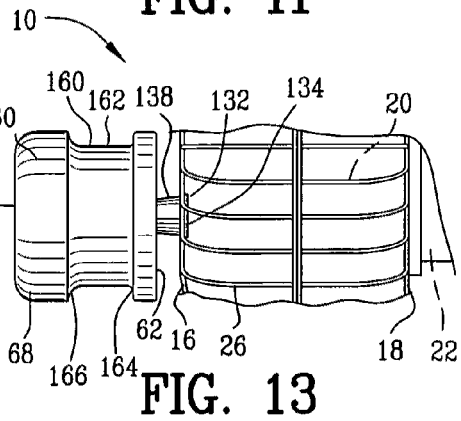
FIG. 13 is a view similar to FIG. 12 illustrating the compression rod engaged with the compression socket and the cylinder engaged with the clamp.

FIGS. 12 and 13 illustrate the steps utilized for next threadably engaging the compression rod 150 with the compression socket 136 for coupling the cylinder 60 to the air vent 14. The cylinder 60 is rotated such that the male threading 154 of the compression rod 150 threadably engages the female threading 152 of the compression socket 136. The keying between the key receiver 90 and the key 110 prevents rotation of the male threading 154 relative to the cylinder 60 during the male threading 154 threadably engages the female threading 152.

The continued rotation of the cylinder 60 causes the distance between the backing plate 134 and the frontal plate 148 to reduce. Since the length of the annular spacer 138 is greater than the length of the compression socket 136, the frontal plate 148 abuts the second spacer surface 144 and the plurality of rods 26 abut the backing plate 134 and the first spacer surface 142. Upon the distance between the backing plate 134 and the frontal plate 148 reaching a length which is lower than that of the annular spacer 138, the clamp 130 causes a compressive force between the first spacer surface 142 and backing plate 134. The compressive force presses the first spacer surface 142 and backing plate 134 against the plurality of rods 26 for locking the cylinder 60 to the air vent 14.

Figure 14:
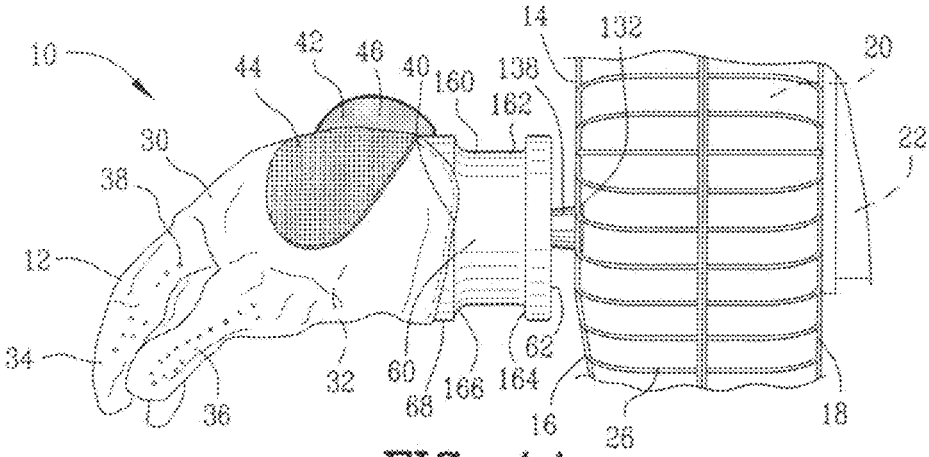
FIG. 14 is a view similar to FIG. 1 illustrating the glove positioned for engaging the cylinder.
Figure 15:
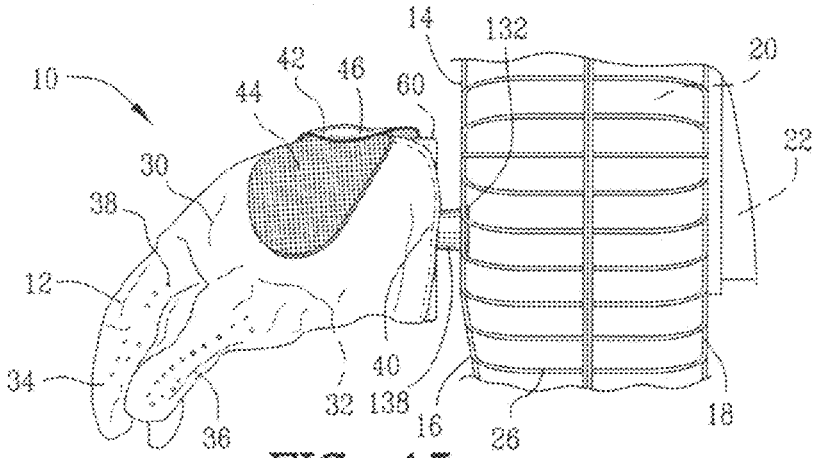
FIG. 15 is a view similar to FIG. 14 illustrating the glove engaged with the cylinder.
Figure 16:
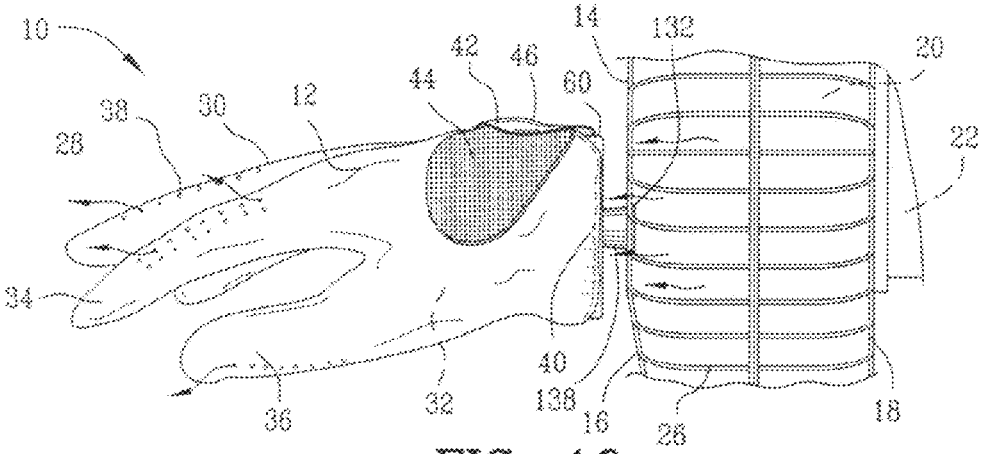
FIG. 16 is a view similar to FIG. 15 illustrating an airflow displaced from the air vent, through the cylinder and through the glove.
Figure 17:
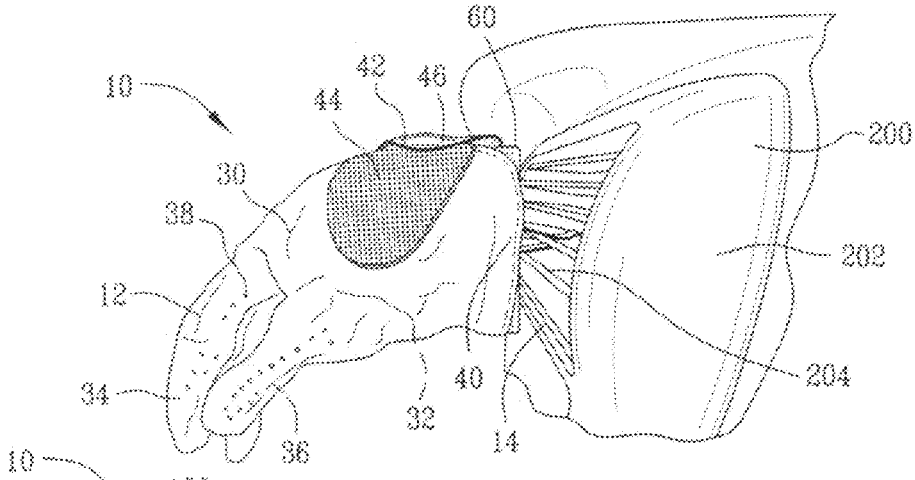
FIG. 17 is side view of a second embodiment of a holder for coupling a glove to an air vent incorporating the present invention.

As best seen in FIGS. 2 and 12 thru 14, the cylinder 60 may include a continuous bore 160. The continuous bore 160 defines a first step 164 and a second step 168 for positioning a bore surface 162 below the exterior surface 68 of the cylinder 60. FIGS. 14 thru 16 illustrate the steps utilized for securing the glove 12 to the cylinder 60. The cylinder 60 is inserted into the aperture 40 of the glove 12 such that the cylinder is positioned within the interior cavity 32 of the glove 12. Preferably, the cylinder 60 is inserted within the interior cavity 32 until the aperture 40 is adjacent to the intake end 62 of the cylinder 60. The operator of the glove holder 10 compresses the body 30 of the glove 12 until the body 30 abuts with the exterior surface 68 of the cylinder 60 and a portion of the body 30 is inserted within the continuous bore 160. The keeper 42 is engaged to retain the body 30 of the glove 12 against the exterior surface 68 and a portion of the body 30 within the continuous bore 160. The resistance between the body 30 of the glove 12 with the exterior surface 68 of the cylinder 60 in conjunction with the insertion of a portion the body 30 within the continuous bore 160 secures the glove 12 relative to the cylinder 60.

In FIG. 16 the rotation of the blade assembly 20 by the motor 22 causes airflow 28 to exit the air vent 14. The cylinder 60 funnels a portion of the airflow 28 from the intake end 62, through the interior bore 70, past the exhaust end 64 and into the interior cavity 32 of the glove 12. The airflow 28 within the interior cavity 32 absorbs moisture and exits the glove 12 through a plurality of vent openings 38. The displacement of the moisture from the glove 12 dries the glove 12.

FIGS. 17 thru 28 are various view of a second embodiment of a glove holder 10 for coupling a glove 12 to an air vent 14. The air vent 14 is located within an automobile 200. The automobile 200 has a dash board 202 incorporating the air vent 14. The air vent 14 includes a plurality of ventilation plates 204.

In FIGS. 19, 20, 22 and 23 a key receiver 90 is secured to the second end 76 of the support arm 72. The key receiver 90 includes a first receiver channel 92 and a second receiver channel 94 separated by a receiver plate 96. The key receiver 90 may further include a third receiver channel 98 interposed between the first receiver 90 and the second receiver channel 94. The first and second receivers 90 and 92 and the receiver plate 96 define a rectangular groove 100.

Preferably, the cylinder 60, the support arm 72, and the key receiver 90 are an integral one piece unit constructed from a metallic, polymeric or other rigid material. Alternatively, the cylinder 60, the support arm 72, and the key receiver 90 may include individual components constructed from metallic, polymeric or other rigid material and fastened by welding, gluing or other fastening techniques.

The cylinder 60 may also incorporate a second support arm 78 extending from a first end 80 to a second end 82. The first end 80 of the second support arm 78 is secured to the interior surface 66 of the cylinder 60. The second end 82 of the second support arm 78 is positioned within the interior bore 70. The key receiver 90 is secured to the second end 82 of the second support arm 78. Furthermore the cylinder 60 may include a third support arm 84 extending from a first end 86 to a second end 88. The first end 86 of the third support arm 84 is secured to the interior surface 66 of the cylinder 60. The second end 88 of the third support arm 84 is positioned within the interior bore 70. The key receiver 90 is secured to the second end 88 of the third support arm 84. The addition of the second and third support arms 78 and 84 provide addition support between the cylinder 60 and the key receiver 90. Preferably, the cylinder 60, the second and third support arms 78 and 84, and the key receiver 90 are an integral one piece unit constructed from a metallic, polymeric or other rigid material. Alternatively, the cylinder 60, the second and third support arms 78 and 84, and the key receiver 90 may include individual components constructed from metallic, polymeric or other rigid material and fastened by welding, gluing or other fastening techniques.

A key 110 has a first key flange 112 and a second key flange 114 separating by a key plate 116. The key 110 may further include a third key flange 118 interposed between the first key flange 112 and the second key flange 114. The key 110 is positioned within the rectangular groove 100 such that the first key flange 112, second key flange 114 and the third key flange 118 slidably engage the first receiver channel 92, second receiver channel 94 and the third receiver channel 98 respectively. With the first key flange 112, second key flange 114 and third key flange 118 engaged with the first receiver channel 92, second receiver channel 94 and the third receiver channel 98 respectively, the receiver plate 96 is positioned adjacent to the key plate 116. The key 110 may not be displaced relative to the key receiver 90 unless the key 110 is slidably displaced within the rectangular groove 100 in the opposite direction from which the key 110 was inserted.

In FIGS. 18 thru 23 a clamp 130 is illustrated for securing to the air vent 14. The clamp 130 includes a band coupler 170 securing a first binder band 172 adjacent to a second binder band 180. The first binder band 172 provides a first converging portion 174, a first inverting portion 176 and a first diverging portion 178. The second binder band 180 provides a second converging portion 182, a second inverting portion 184 and a second diverging portion 186. The first inverting portion 176 and second inverting portion 186 define an initial chamber 190. The first converging portion 174 and the second converging portion 182 define a secondary chamber 192. Preferably, the band coupler 170, first binder band 172 and second binder band 180 are an integral one piece unit constructed from a metallic, polymeric or other rigid material. Alternatively, the band coupler 170, first binder band 172 and second binder band 180 may include individual components constructed from metallic, polymeric or other rigid material and fastened by welding, gluing or other fastening techniques.

The first binder band 172 and second binder band 180 may be displaced from each other for providing a compressive force therebetween. The band coupler 170 may position the first binder band 172 and second binder band 180 such that the first inverting portion 176 makes contact with the second inverting portion 184. In addition, the band coupler 170 may provide a pre-stressed force between the first binder band 172 and second binder band 180 while the first inverting portion 176 makes contact with the second inverting portion 184.

The key plate 116 is attached to the band coupler 170 for securing the first binder band 172 and second binder band 180 of the clamp 130 to the key receiver 90 of the cylinder 60 upon the key 110 slidably engaging the rectangular groove 100. Preferably, the band coupler 170, and the key 110 may include an integral one piece unit constructed from a metallic, polymeric or other rigid material. Alternatively, the band coupler 170 and the key 110 may include individual components constructed from metallic, polymeric or other rigid material and fastened by welding, gluing or other fastening techniques.

Figure 22:
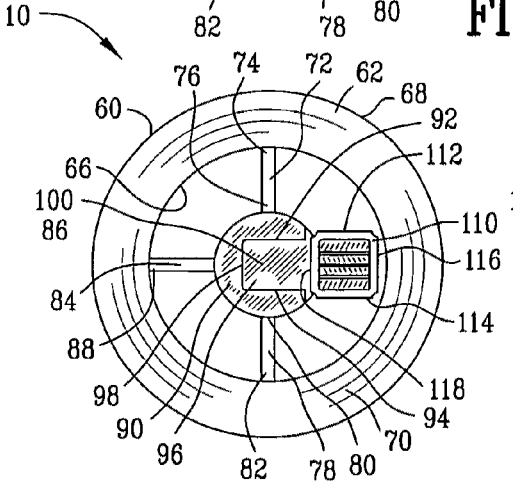
FIG. 22 is a view similar to FIG. 20 illustrating a key positioned for engaging a key receiver.
Figure 23:
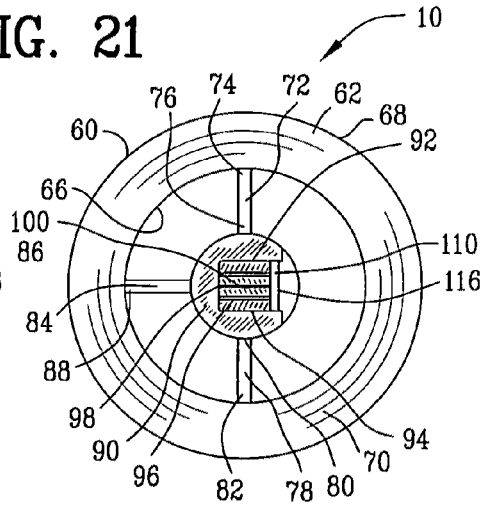
FIG. 23 is a view similar to FIG. 22 illustrating the key engaged with the key receiver.

FIGS. 4 thru 28 illustrate the steps utilized for securing the glove holder 10 to the air vent 14. FIGS. 22 and 23 illustrate the steps utilized for coupling the band coupler 170 of the clamp 130 to the cylinder 60. The key 110 is positioned within the rectangular groove 100 such that the first key flange 112 and second key flange 114 slidably engage the first receiver channel 92 and second receiver channel 94 respectively. The key 110 is slide within the rectangular groove 100 until the third key flange 118 slidably engages the third receiver channel 98.

With the first key flange 112, second key flange 114 and third key flange 118 engaged with the first receiver channel 92, second receiver channel 94 and the third receiver channel 98 respectively, the receiver plate 96 is positioned adjacent to the key plate 116. The key 110 may not be displaced relative to the key receiver 90 unless the key 110 is slidably displaced within the rectangular groove 100 in the opposite direction from which the key 110 was inserted.

Figure 18:
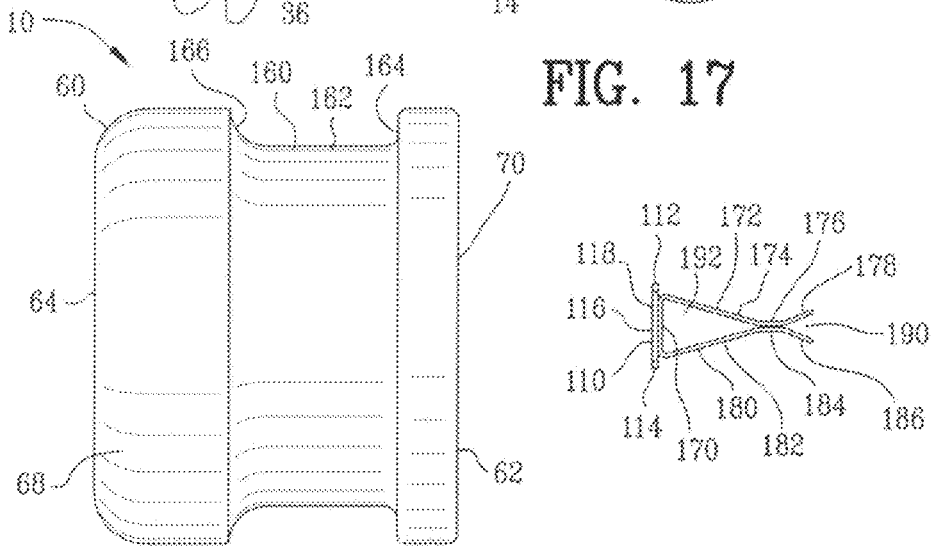
FIG. 18 is an exploded view of the second embodiment of the holder utilized in FIG. 17.
Figure 19:
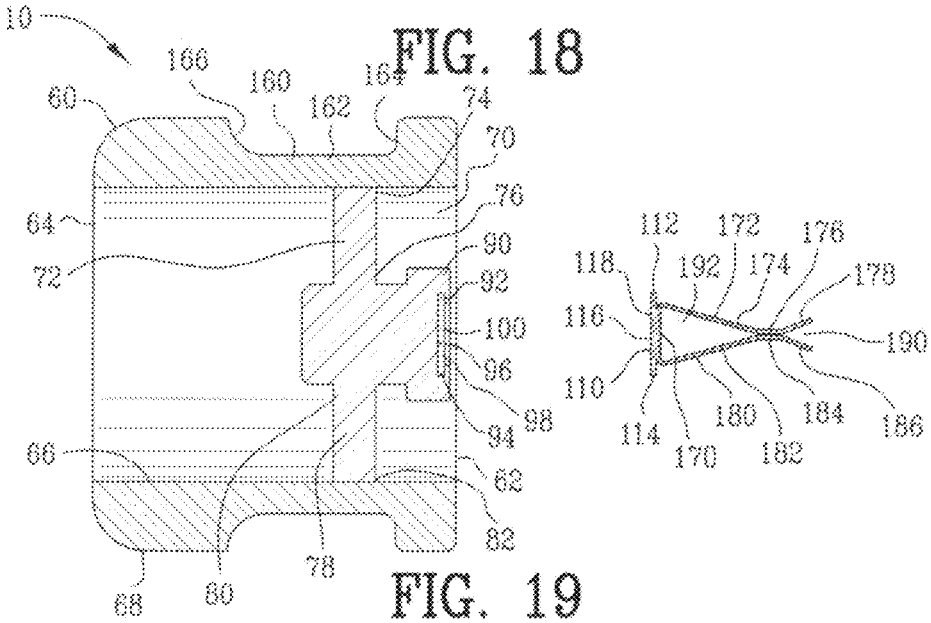
FIG. 19 is a centered sectional view of FIG. 18.
Figure 20:
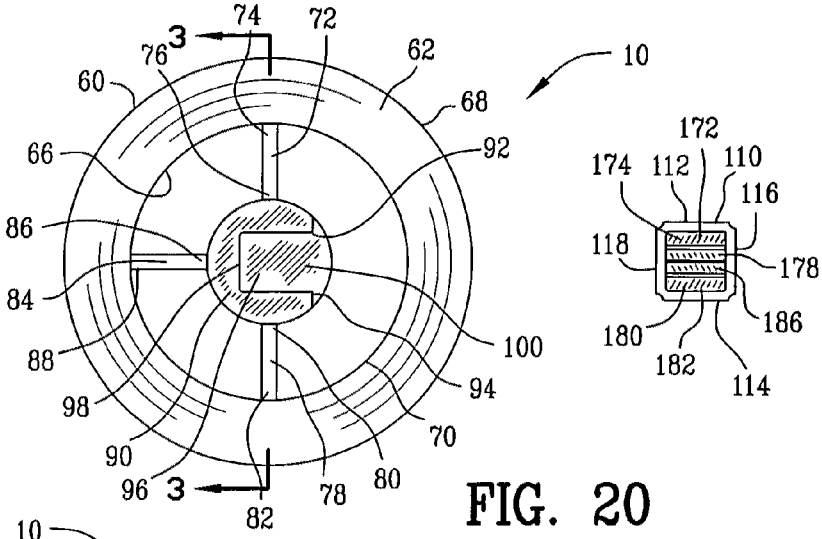
FIG. 20 is a front view of the holder of FIG. 18.
Figure 21:
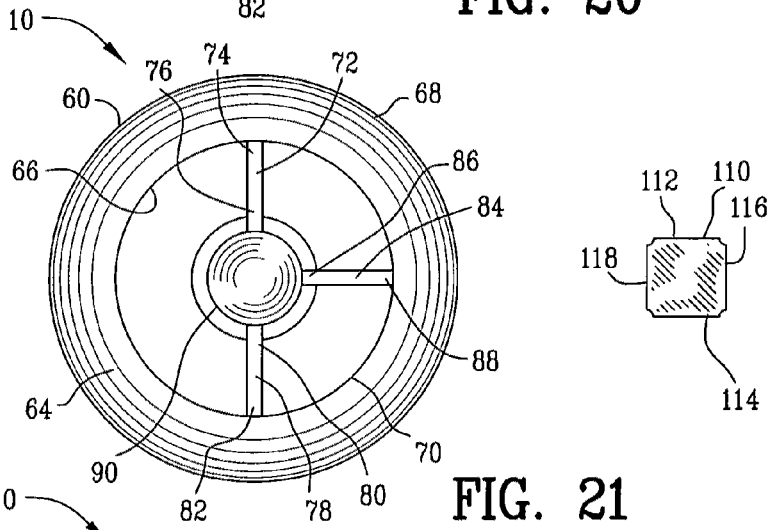
FIG. 21 is a rear view of the holder of FIG. 18.
Figure 24:
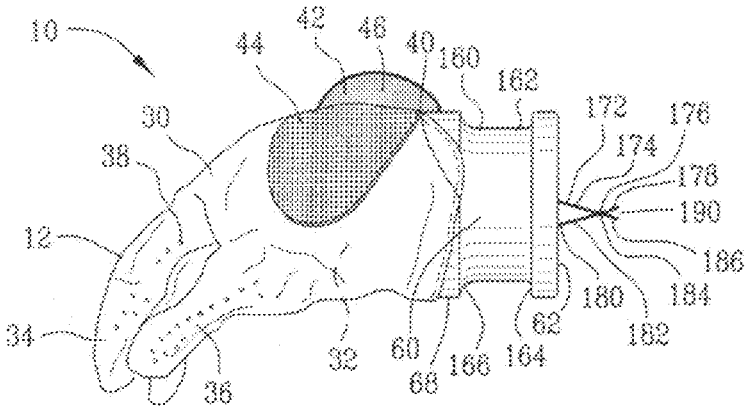
FIG. 24 is a view similar to FIG. 17 illustrating the glove positioned for engaging the cylinder.
Figure 25:
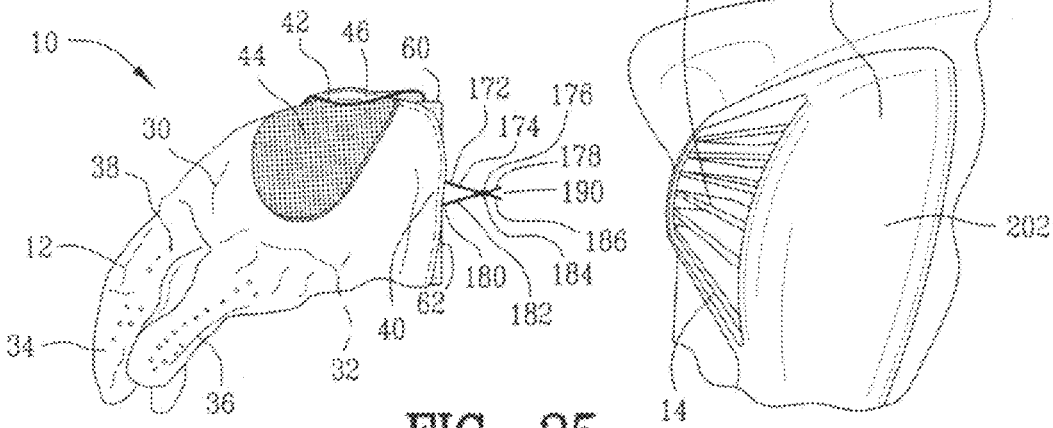
FIG. 25 is a view similar to FIG. 24 illustrating the glove engaged with the cylinder.

As best seen in FIGS. 18, 19 and 24, the cylinder 60 may include a continuous bore 160. The continuous bore 160 defines a first step 164 and a second step 168 for positioning a bore surface 162 below the exterior surface 68 of the cylinder 60. FIGS. 24 thru 25 illustrate the steps utilized for securing the glove 12 to the cylinder 60. The cylinder 60 is inserted into the aperture 40 of the glove 12 such that the cylinder is positioned within the interior cavity 32 of the glove 12. Preferably, the cylinder 60 is inserted within the interior cavity 32 until the aperture 40 is adjacent to the intake end 62 of the cylinder 60. The operator of the glove holder 10 compresses the body 30 of the glove 12 until the body 30 abuts with the exterior surface 68 of the cylinder 60 and a portion of the body 30 is inserted within the continuous bore 160. The keeper 42 is engaged to retain the body 30 of the glove 12 against the exterior surface 68 and a portion of the body 30 within the continuous bore 160. The resistance between the body 30 of the glove 12 with the exterior surface 68 of the cylinder 60 in conjunction with the insertion of a portion the body 30 within the continuous bore 160 secures the glove 12 relative to the cylinder 60.

Figure 26:
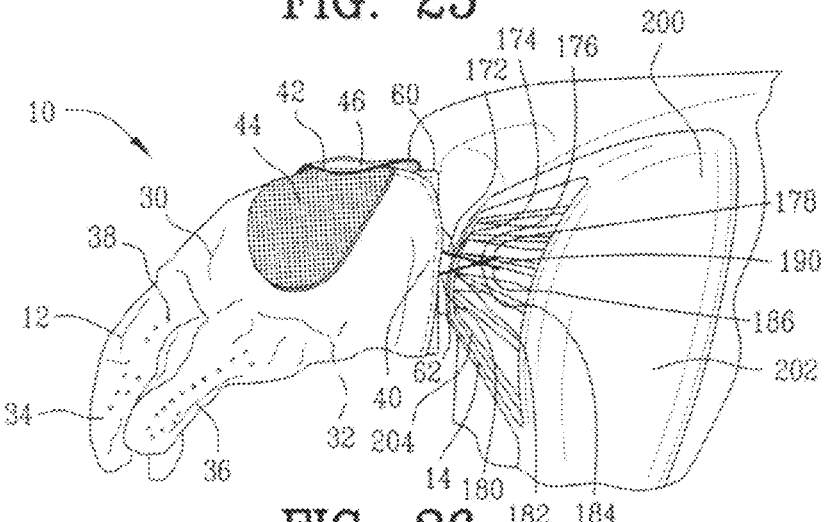
FIG. 26 is a view similar to FIG. 25 illustrating a first binder band and a second binder band positioned for engaging the air vent.
Figure 27:
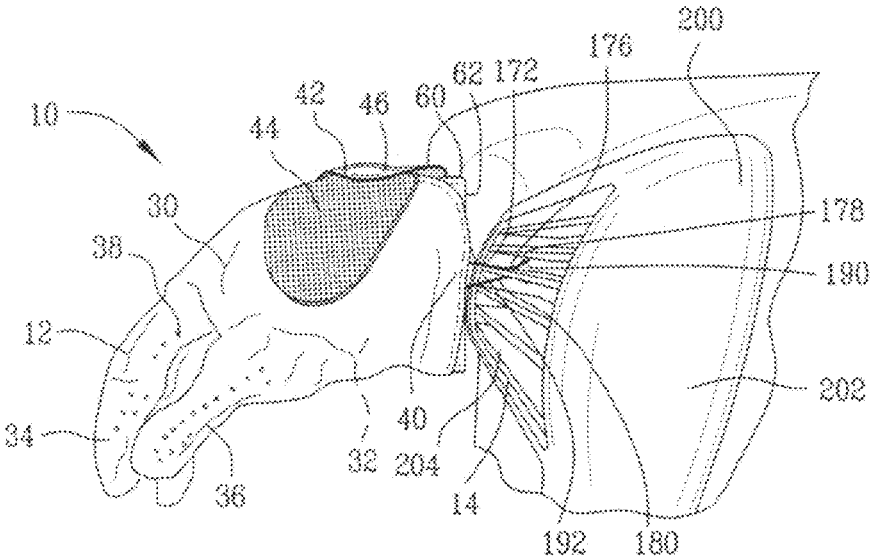
FIG. 27 is a view similar to FIG. 26 illustrating the first binder band and the second binder band engaged the air vent.

FIGS. 26 and 27 illustrate the steps utilized for coupling the cylinder 60 to the air vent 14. The ventilation plate 204 is positioned within the initial chamber 190. A forward force is applied to the cylinder 60 to force the ventilation plate 204 to displace the first binder band 172 and the second binder band 180. Upon displacement of the first binder band 172 and the second binder band 180, the ventilation plate 204 separates the first inverting portion 176 and the second inverting portion 184. Separation of the first and second inverting portions 176 and 184 permit the ventilation plate 204 to slidably enter the secondary chamber 192 for the clamp 130 to engage the ventilation plate 204. The first binder band 172 and the second binder band 180 continue to apply a compressive force to the ventilation plate 204 for securing the glove holder 10 to the air vent 14.

Figure 28:
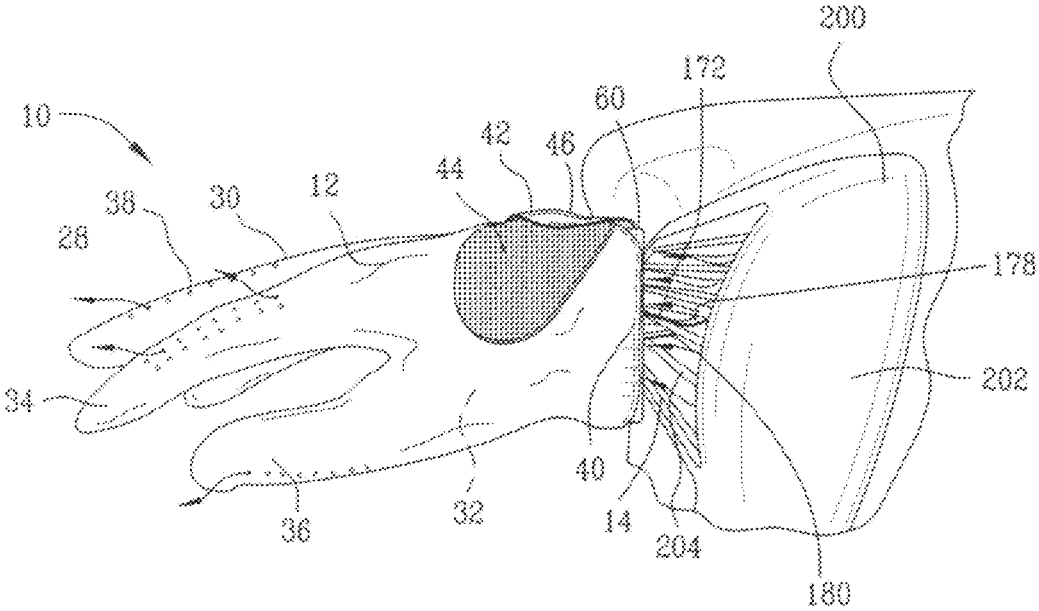
FIG. 28 is a view similar to FIG. 27 illustrating an airflow displaced from the air vent, through the cylinder and through the glove.
Figure 29:
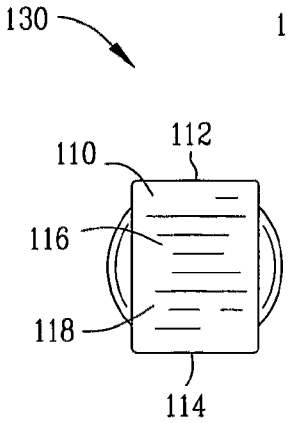
FIG. 29 is a rear view of a third embodiment of a holder for coupling a glove to an air vent incorporating the present invention.
Figure 30:
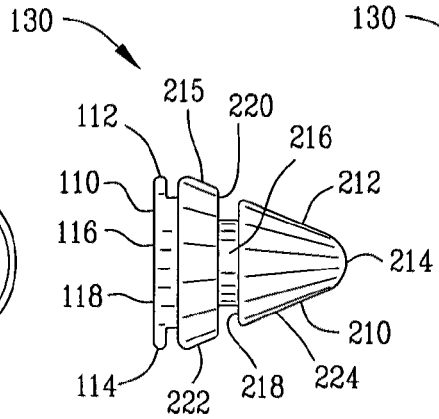
FIG. 30 is a side view of FIG. 29.
Figure 31:
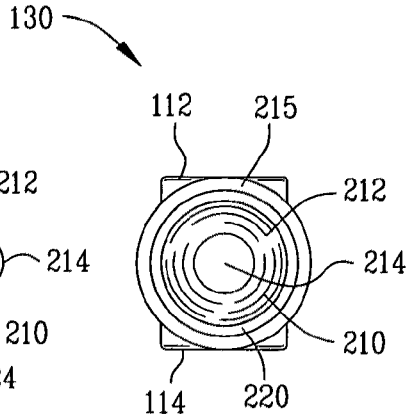
FIG. 31 is a front view of FIG. 29.
Figure 32:
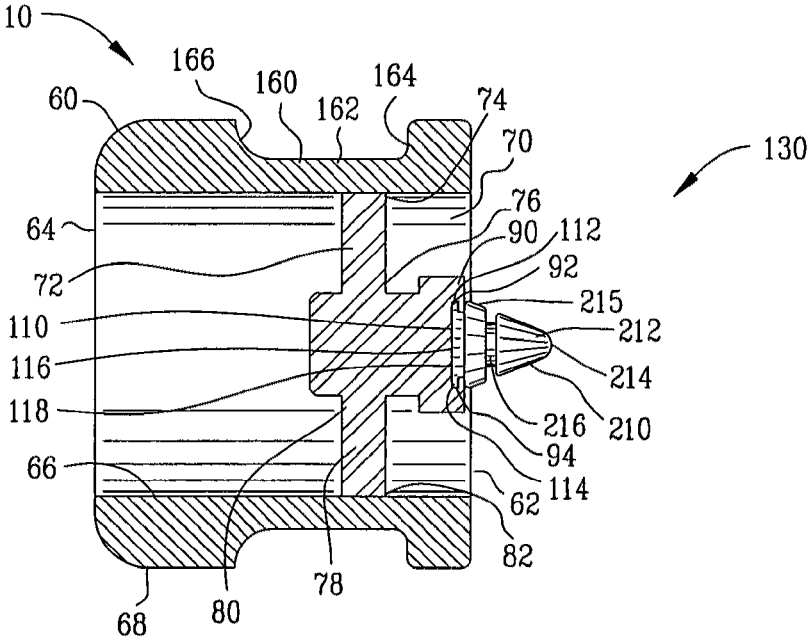
FIG. 32 is a view similar to FIG. 19 illustrating a conical backing engaging the cylinder.

In FIG. 28 the rotation of the blade assembly 20 by the motor 22 causes airflow 28 to exit the air vent 14. The cylinder 60 funnels a portion of the airflow 28 from the intake end 62, through the interior bore 70, past the exhaust end 64 and into the interior cavity 32 of the glove 12. The airflow 28 within the interior cavity 32 absorbs moisture and exits the glove 12 through a plurality of vent openings 38. The displacement of the moisture from the glove 12 dries the glove 12.

FIGS. 29-35 illustrate a third embodiment for the subject invention wherein the clamp 130 extends between the key 110 and a conical backing 210. The conical backing 210 includes a tapering surface 212 contracting to a point 214. The first key flange 112 and the second key flange 114 slidably engaging the first receiver channel 92 and the second receiver channel 94 respectively for positioning the receiver plate 96 adjacent to the key plate 116.

The conical backing 210 engaging the fan shroud 19 of the air vent 14 for positioning the fan shroud 19 between the key 110 and the conical backing 210. The point 214 facilitates the insertion of the conical backing 210 between the plurality of rods 26 in the fan shroud 19. The tapering surface 212 facilitates the expanding of the plurality of rods 26 for positioning the fan shroud 19 between the key 110 and the conical backing 210. The air flow 28 is displaced from the air vent 14, through the interior bore 70 of the cylinder 60 and through the body 30 of the glove 12 for facilitates the removal of moisture within the glove 12.

A conical spacer 215 may couple the key 110 and the conical backing 210 for spacing the conical backing 210 from the cylinder 60. The conical spacer 215 may include a second tapering surface 222 for preventing the shroud 19 from contacting the cylinder 60. A grasping groove 216 may be interposed between the conical spacer 215 and the conical backing 210. The grasping groove 216 defines a conical grasping surface 218 on the conical backing 210 and a spacer grasping surface 220 on the conical spacer 215.

Figure 33:
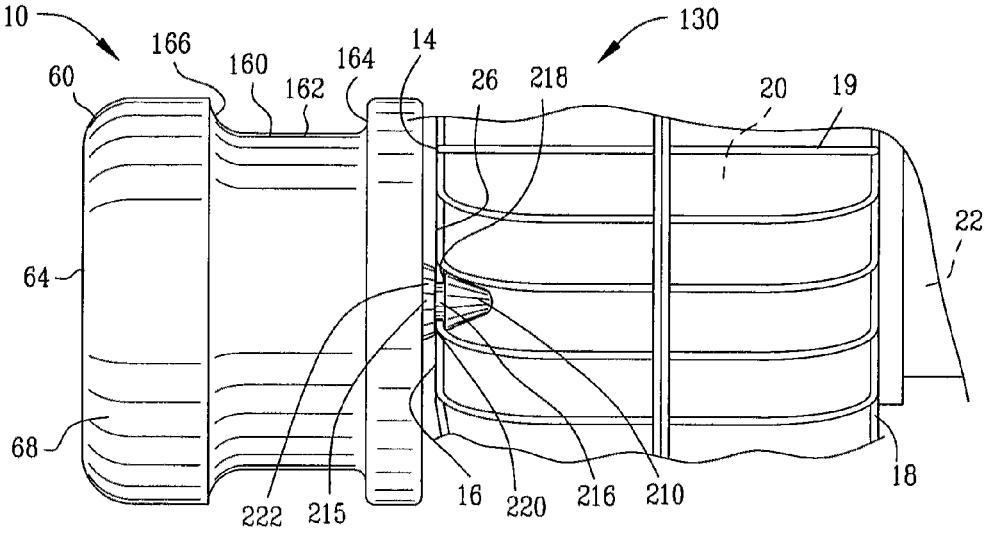
FIG. 33 is a view similar to FIG. 32 illustrating the third embodiment engaging an air vent.
Figure 34:
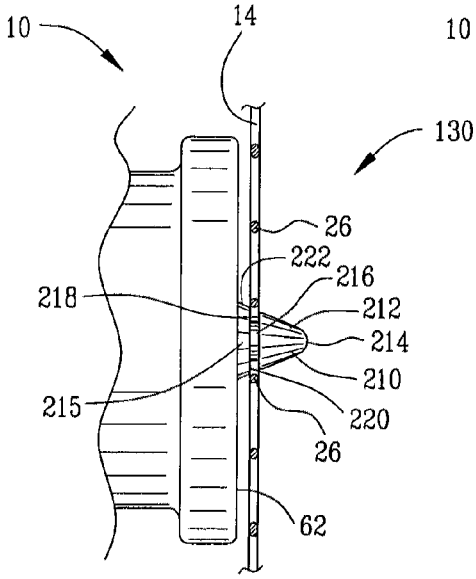
FIG. 34 is an enlarged view of FIG. 33 wherein the air vent is sectioned.
Figure 35:
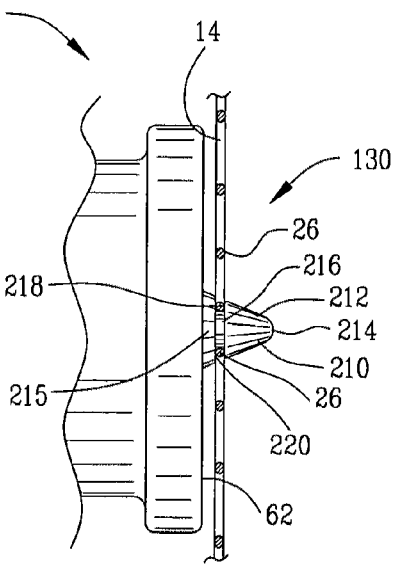
FIG. 35 is a view similar to FIG. 34 illustrating the conical engaging the air vent.

As best seen in FIGS. 33 and 34, the conical backing 210 is inserted into the fan shroud 19 wherein the plurality of rods 26 are at maximum distance. Thereafter, as shown in FIG. 35, the clamp 130 may be slide into a position wherein the plurality of rods 26 are at minimum distance. At the minimum distance the grasping groove 216, the conical grasping surface 218 and the spacer grasping surface 220 frictionally engage the fan shroud 19 of the air vent 14 for securing the fan shroud 19 to the cylinder 60. Preferably, the conical backing 210, conical spacer 215 and the key 110 are constructed of a integral one piece unit 224.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A glove holder for coupling a glove to an air vent, the glove having a body defining an interior cavity, the body having an aperture for accessing the interior cavity, the air vent discharging an air flow over a fan shroud, the air flow drying the glove, the glove holder, comprising:

a cylinder having an intake end, an exhaust end, an interior surface, and an exterior surface;

said interior surface defining an interior bore extending from said intake end to said exhaust end;

said cylinder being insertable through the aperture and into the interior cavity of the body for positioning said exterior surface of said cylinder adjacent to the body of the glove;

a support arm extending from a first end to a second end;

said first end of said support arm securing to said interior surface of said cylinder;

said second end of said support arm positioning within said interior bore;

a key receiver securing to said second end of said support arm;

said key receiver including a first receiver channel and a second receiver channel separating by a receiver plate;

a clamp extending between a key and a conical backing;

said key including a first key flange and a second key flange separating by a key plate;

said conical backing including a tapering surface contracting to a point;

said first key flange and said second key flange slidably engaging said first receiver channel and said second receiver channel respectively for positioning said receiver plate adjacent to said key plate;

said conical backing engaging the fan shroud of the air vent for positioning the fan shroud between said key and said conical backing; and the air flow displacing from the air vent, through said interior bore of said cylinder and through the body of the glove.

2. A glove holder for coupling a glove to an air vent as set forth in claim 1, further including a conical spacer coupling said key and said conical backing for spacing said conical backing from said cylinder.

3. A glove holder for coupling a glove to an air vent as set forth in claim 1, further including a conical spacer coupling said key and said conical backing for spacing said conical backing from said cylinder;

a grasping groove interposed between said conical spacer and said conical backing;

said grasping groove defining a conical grasping surface on said conical backing and a spacer grasping surface on said conical spacer; and said grasping groove, said conical grasping surface and said spacer grasping surface engaging the fan shroud of the air vent for securing the fan shroud to said cylinder.

4. A glove holder for coupling a glove to an air vent as set forth in claim 1, further including a conical spacer coupling said key and said conical backing for spacing said conical backing from said cylinder;

a grasping groove interposed between said conical spacer and said conical backing;

said grasping groove defining a conical grasping surface on said conical backing and a spacer grasping surface on said conical spacer;

said conical spacer including a second tapering surface for preventing the shroud from contacting said cylinder; and said grasping groove, said conical grasping surface and said spacer grasping surface engaging the fan shroud of the air vent for securing the fan shroud to said cylinder.

* * * * *